US007439529B2

(12) United States Patent
Tantraporn et al.

(10) Patent No.: US 7,439,529 B2
(45) Date of Patent: Oct. 21, 2008

(54) HIGH CURRENT DENSITY ION SOURCE

(75) Inventors: Wirojana Tantraporn, Bangkok (TH); Surawut Kitsumpun, Bangkok (TH)

(73) Assignee: The Thailand Research Fund, Bangkok (TH)

( * ) Notice: Subject to any disclaimer, the term of this patent is extended or adjusted under 35 U.S.C. 154(b) by 387 days.

(21) Appl. No.: 11/056,418

(22) Filed: Feb. 11, 2005

(65) Prior Publication Data

US 2005/0218816 A1 Oct. 6, 2005

(30) Foreign Application Priority Data

Feb. 12, 2004 (TH) ..... 088699

(51) Int. Cl.
*H01J 7/24* (2006.01)

(52) U.S. Cl. ..... 250/493.1; 315/111.81

(58) Field of Classification Search ..... 250/493.1
See application file for complete search history.

(56) References Cited

U.S. PATENT DOCUMENTS 4,996,077 A * 2/1991 Moslehi et al. ..... 427/562
6,355,902 B2 * 3/2002 Akahori et al. ..... 219/121.43
6,518,195 B1 * 2/2003 Collins et al. ..... 438/723
6,805,779 B2 * 10/2004 Chistyakov ..... 204/298.36

* cited by examiner

*Primary Examiner*—David A. Vanore
*Assistant Examiner*—Phillip A. Johnston
(74) *Attorney, Agent, or Firm*—Steven L. Nichols; Rader, Fichsman & Grauer PLLC

(57) ABSTRACT

A high current density ion beam source includes a plasma source for generating plasma, a vacuum chamber coupled to the plasma source for extracting an ion beam from the plasma generated by the plasma source, a microwave field source configured to produce a microwave field that causes an ionization of gas within the plasma source, and a direct current voltage source configured to initiate an avalanche multiplication within the plasma source. The avalanche multiplication increases the ionization of gas in the plasma source and causes an increase in a current density of the ion beam.

20 Claims, 7 Drawing Sheets

HIGH CURRENT DENSITY ION SOURCE

RELATED APPLICATION

The present application claims priority under 35 U.S.C. § 119 from the following previously-filed Thai Patent Application, Thai Application No. 088699, filed on Feb. 12, 2004 in the name of Wirojana Tantraporn et al., entitled "High Current Density Ion Source" which is incorporated herein by reference in its entirety.

FIELD OF THE INVENTION

The present invention relates to plasma physics.

BACKGROUND

Conventional direct current (DC) ion sources, also called high current density ion sources, are often used in semiconductor processing and in other applications. A typical DC ion source may comprise a plasma system that produces the desired ions and an extraction and focusing system. Plasma may be produced in a plasma chamber by ionization of gas under a high DC or RF electric field. The extraction system uses high voltage to extract an ion beam from the plasma. The extracted ion beam is then focused or formed into a parallel beam by the focusing system. A DC electric field is often used to draw ions in the plasma from the extraction system to the focusing system.

High current density ion sources generally are used in etching applications, ion implantation, and in accelerator technology. In order to provide a high current density ion beam, it is necessary for gas in a plasma system to be of a sufficiently high density in order to provide the high-density conduction charge carriers (electrons and ions). Usually the high-density plasma is created ionizing gas with a high-energy external RF field. However, the plasma density will eventually reach saturation regardless of the strength external RF field.

Most high current density ion sources also use magnetic fields to excite and maintain the plasma. However, the main purpose of the magnetic fields is to confine the plasma flow within the system such that the plasma does not come into contact with the internal surface of the plasma chamber. Magnetic fields force the conduction charge carriers (electron and ions) in the plasma into a circular orbit to reduce the amount of the plasma which otherwise would come in contact with the internal surface of the plasma chamber. The magnetic fields also reduce the need for cooling of the chamber and prevent contamination within the plasma. However, the magnetic fields may also cause the temperature of the plasma itself to increase.

The high-energy external RF field used to ionize and produce the high-density plasma and the magnetic fields produce heat within the plasma system. As the temperature of the plasma system increases, the efficiency of the system decreases. Therefore, a conventional ion source typically uses a cooling system, such as an air or water cooling system.

In addition to receiving energy from of the high energy external field which ionizes the gas, the ions within the plasma also gain energy from the high-energy extraction field produced by an extraction system. The extraction field also causes the conduction charge carriers to move into spiral around the magnetic field line of the extraction field. Thus, the ions in the beam will have a high kinetic energy spread due to both the high electric fields mentioned above and the lateral velocity spread due to the magnetic field, making it difficult for subsequent focusing.

In summary, the following characteristics are found in many currently available high current density ion sources. First, external RF fields and magnetic fields are used to ionize the gas and confine the plasma. Next, most high current density ion sources include a cooling system to dissipate the temperature of the system. Finally, an extraction system comprising a high DC electric field is used to extract the ions from the plasma to produce the ion beam.

A typical ion source is an Electron Cyclotron Resonance (ECR) ion source 100 as shown in FIG. 1. The ECR ion source 100 necessarily operates with a high magnetic field to fulfill the resonance condition of the microwave frequency and electron cyclotron frequency. The microwave power 10 enters a cavity of a plasma chamber 16 through a cylindrical waveguide 13 and ceramic window 11 to ionize gas that is input via a gas inlet 15. The standard microwave frequency of 2.45 GHz is used, leading to a required magnetic field of 0.0875 tesla to confine the plasma within the cavity 16. In addition, a high DC electric potential is used to extract an ion beam 14 from the plasma. Hence the ion beam 14 has a large energy spread. In addition, in order to produce a plasma with the ECR ion source 100, it is necessary to provide a long collision free path, which limits the pressure in the plasma chamber 16 to be <10-3 mbar. At this low pressure, the ion current density is limited by the available number of gas atoms per cubic centimeter ($cm^3$) in the plasma source. Hence the ECR ion source 100 of FIG. 1 cannot provide high ion beam intensity.

U.S. Patent Publication 20020000779 describes methods for producing a linear array of streaming flux of plasma with low energy ions and electrons to synthesize atomic thin crystal-like thin films on the surface of a substrate. The plasma flux described in this patent publication is suitable for a large cross section area deposition process that does not necessarily need a very high density plasma source.

SUMMARY

In one of many possible embodiments, the present invention provides a high current density ion source configured to produce a high current density ion beam with a low total power consumption. For example, the total power consumption may be substantially equal to or less than 50 watts. The high current density ion source is further configured to produce anion flux which has a relatively low initial kinetic energy and energy spread. The high current density ion source comprises the following: 1) a microwave source of 2.45 GHz frequency configured to ignite a plasma (ions and electrons) in the source gas, 2) a DC voltage source configured to initiate and maintain the avalanche multiplication with in the gas, 3) a cathode electrode configured to yield secondary electrons upon arrival of the ion current and 4) a vacuum external to the gas plasma source of the order of $10^{-4}$ mbar or lower.

The resulting high current density ion flux also makes use of the pressure gradient between the plasma chamber (inside pressure substantially equal to $10^{-1\pm1}$ mbar) and the enclosing vacuum chamber (inside pressure $\leqq 10^{-4}$ mbar). The ions in the cathode side space-charge layer (where the slope of the relation of the electric field and distance in non-zero, i.e. $dE/dx \neq 0$) are driven not only by the electric field but also by the higher pressure in the plasma chamber through a small orifice to the lower pressure in the enclosing vacuum chamber with nearly the speed of sound. The current density of the ion beam may be several amperes per square centimeter ($A/cm^2$) with the high quality beam. The initial kinetic energy of ion beam may be less than 50 electron volts (eV). Finally, the ion beam may have a relatively small energy spread.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

In making a high current density ion beam of high quality having low divergence and low energy spread, the controlling factor is the nature of the plasma source and extraction system. A direct current (DC) ion source is described herein that uses microwave energy as the initial energizer to yield plasma with good spatial uniformity and high brightness. Hence, the high current density ion beam produced by the DC ion source may be easily focused and scanned. The ion beam may then be used in any of a number of applications including, but not limited to, etching applications, ion implantation, and accelerator technology.

In some embodiments, the high current density ion source is configured to produce a high current density ion beam with a low total power consumption. For example, the total power consumption may be substantially equal to or less than 50 watts. The high current density ion source is further configured to produce anion flux which has a relatively low initial kinetic energy and energy spread. Furthermore, the ion source is configured to produce an ion beam that has a temperature slightly greater than room temperature (e.g., approximately equal to 27 degrees Celsius.) The high current density ion source comprises the following: 1) a microwave source of 2.45 GHz frequency configured to ignite a plasma (ions and electrons) in the source gas, 2) a DC voltage source configured to initiate and maintain an avalanche multiplication with in the gas, 3) a cathode electrode configured to yield secondary electrons upon arrival of the ion current and 4) a vacuum external to the gas plasma source of the order of $10^{-4}$ mbar or lower.

In the following description, for purposes of explanation, numerous specific details are set forth in order to provide a thorough understanding of the present systems and methods. It will be apparent, however, to one skilled in the art that the present systems and methods may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Figure 2:
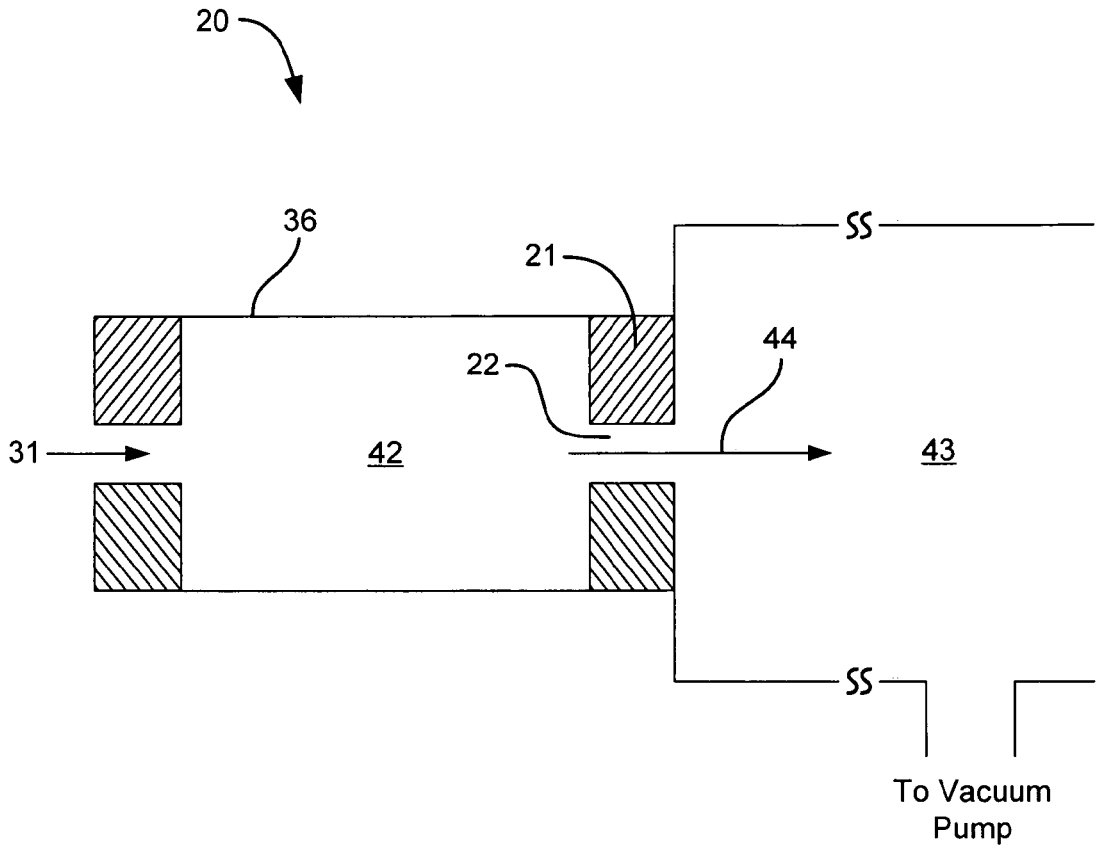
FIG. 2 illustrates an exemplary high current density microwave-initiated ion source according to principles described herein.

FIG. 2 illustrates an exemplary high current density microwave-initiated ion source 20. The ion source 20 includes a plasma source 36 and a vacuum chamber 43. FIG. 2 shows an electrode 21, which will be referred to herein as a plasma electrode, that is located between plasma source 36 and vacuum chamber 43. A small orifice 22, herein called the ion exit hole, serves as the exit for the plasma beam 44 from the plasma chamber 42 to the vacuum chamber 43. The ion exit hole 22 has a diameter configured to cause a pressure gradient between the plasma chamber 42 and the vacuum chamber 43. For example, the diameter of the ion exit hole 22 may be substantially equal to 500 microns. The vacuum chamber 43 and the plasma chamber 42 may be controlled by balancing the gas flow through the small ion exit hole 22. The plasma chamber 42 is also slowly fed via a gas inlet 31 by a desired gas such as, but not limited to, Argon. The slow feeding of the gas is configured to maintain the pressure inside the plasma chamber 42 such that the pressure is substantially in the range of $10^{-1}$ mbar. Hence, the gas density is approximately equal to $10^{14}$-$10^{15}$ $cm^{-3}$.

In some embodiments, the exit hole 22 has a length that is greater than ten times the diameter of the exit hole 22 so that the plasma beam 44 can successfully be formed and transferred to the vacuum chamber 43. Moreover, the diameter of the exit hole 22 is sufficiently small compared to the total area of the electrode 21 to maintain a desired pressure difference between the plasma chamber 42 and the vacuum chamber 43.

In some embodiments, the length of the plasma chamber 42 is as short as possible to allow control of the plasma by a small DC voltage. By using a small DC voltage to control the plasma, the power needed to operate the ion source 20 is minimized and the need for temperature control may be eliminated.

At a pressure substantially equal to 0.1 mbar, plasma is produced in the plasma chamber 42 having a density of the order of $10^{14}$-$10^{15}$ $cm^{-3}$. In some embodiments, the plasma may be energized with a microwave field substantially equal to 2.45 GHz. However, it will be recognized that the frequency of the microwave field may be any suitable frequency. The microwave field is configured to initialize the plasma. For example, the microwave field may be configured to initially ionize the gas molecules such that there are electrons and ions among the neutral atoms in the plasma. As will be described in more detail below, after the plasma has been initialized, an a controlled avalanche multiplication process maintains the plasma.

The plasma is then driven by the pressure difference through the ion exit hole 22 in the form of a beam at an exit speed substantially equal to or less than the speed of sound. For example, the exit speed may be substantially equal to $10^6$ centimeters per second (cm/sec) without the influence of an extraction electric field. In some embodiments, the beam is a low-energy ion beam that may be easily accelerated, focused, and/or scanned.

Figure 3A:
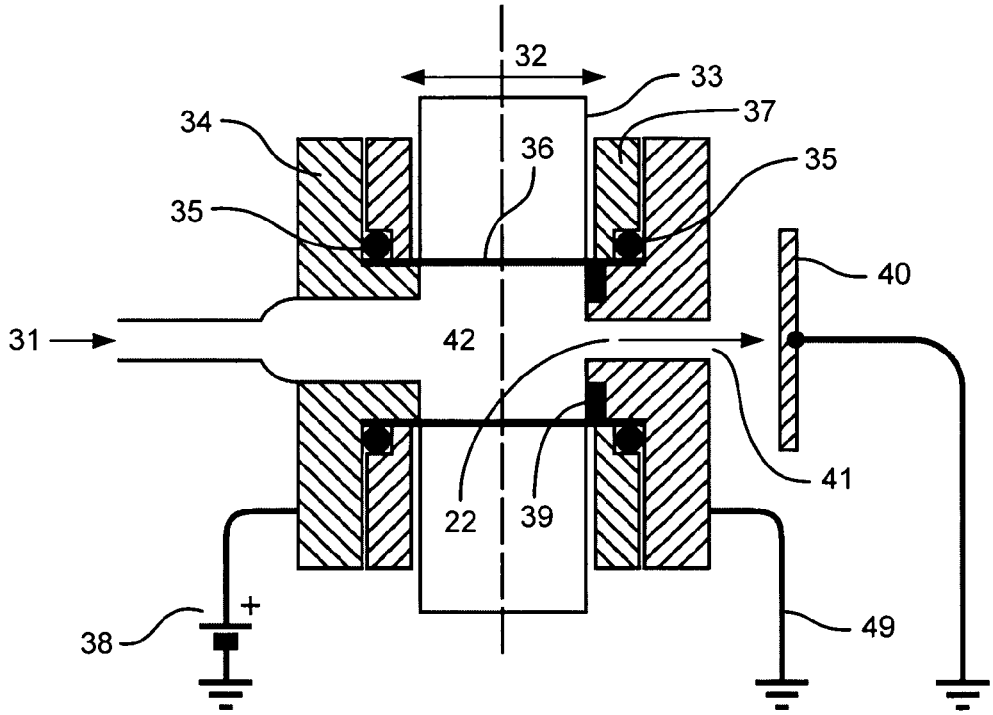
FIG. 3A illustrates an exemplary high current density microwave-initiated ion source of 2.45 GHz frequency according to principles described herein.
Figure 3B:
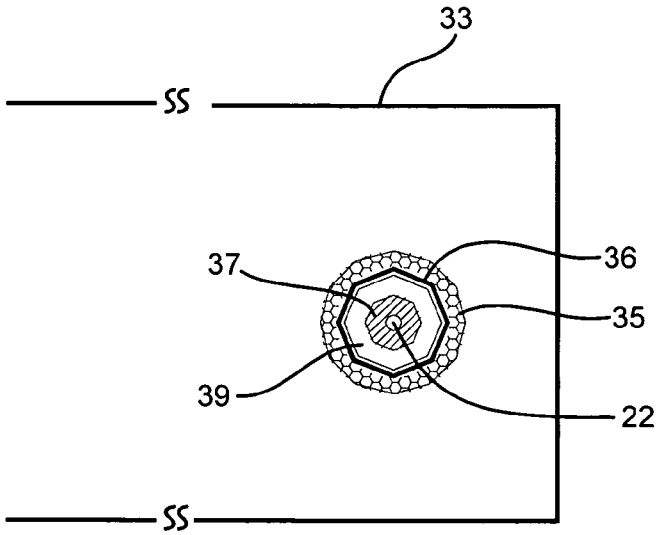
FIG. 3B shows a cross sectional schematic view of the high current density microwave-initiated ion source of 2.45 GHz frequency according to principles described herein.

As shown in FIGS. 3A and 3B, the plasma source 36 may be in the shape of a cylindrical tube. For example, the plasma source 36 may be approximately two centimeters in length and 0.8 centimeters in inner diameter in some examples. The plasma source 36 may be made from quartz or any other suitable material which can withstand operation of the plasma system high temperatures. In some instances, during the production of plasma within the plasma chamber 42, charge may stick to the wall of the chamber 42. This charge may repel further approach of other charges of the same kind. In this manner, the plasma's self confinement may be effectuated in accordance with axial potential distribution.

As shown in FIG. 3B, the plasma system 36 may be installed in a microwave resonant cavity 33 along the width of the cavity 33. An anode electrode 34 and cathode electrode 37 are located at the ends of the plasma chamber 42. The anode electrode 34 is connected to the positive electrode of the DC power supply 38 and the cathode electrode 37 is the reference potential of the system and is connected to ground 49. At the interfaces between the plasma chamber 42 and the anode and cathode electrodes 34, 37, o-rings 35 are installed to prevent gas leakage. Gas inlet 31 is configured to allow a gas, such as Argon (Ar), to pass into the plasma chamber 42. Argon is used in some applications because of the high sputtering yield it can provide. However, it will be recognized that any other type of gas may be input into the plasma chamber 42 to produce the plasma beam.

As mentioned, the plasma may be produced within the plasma chamber 42 using a microwave field 32 having an electric field vector that is aligned with the width of the microwave resonant cavity 33. Within the plasma chamber 42, the plasma which is initiated by the microwave field 32 comprises neutral atoms, ions and electrons. The plasma may be initiated using a plasma initiation mechanism such as a voltage pulse, a microwave igniter, or a laser igniter, depending on the particular application. Under the influence of the microwave field 32, the physical movement of the ions is negligible compared with the movement of the electrons. The movement of the electrons at the frequency of the microwave field 32 can acquire sufficient kinetic energy from microwave acceleration such that, upon collision with neutral atoms, ionization occurs. However, under the influence of the microwave field 32, positive ions, which have a mass several thousand times that of the electrons, are inertially incapable of gaining sufficient kinetic energy to cause ionization of the neutral atoms. Therefore, "charge carrier generation" or the plasma formation under microwave excitation is mainly caused by the collisions of the electrons with the neutral atoms. When an electron collides with an ion, "recombination" may occur which generates radiation and heat and reduces the plasma density.

Figure 4:
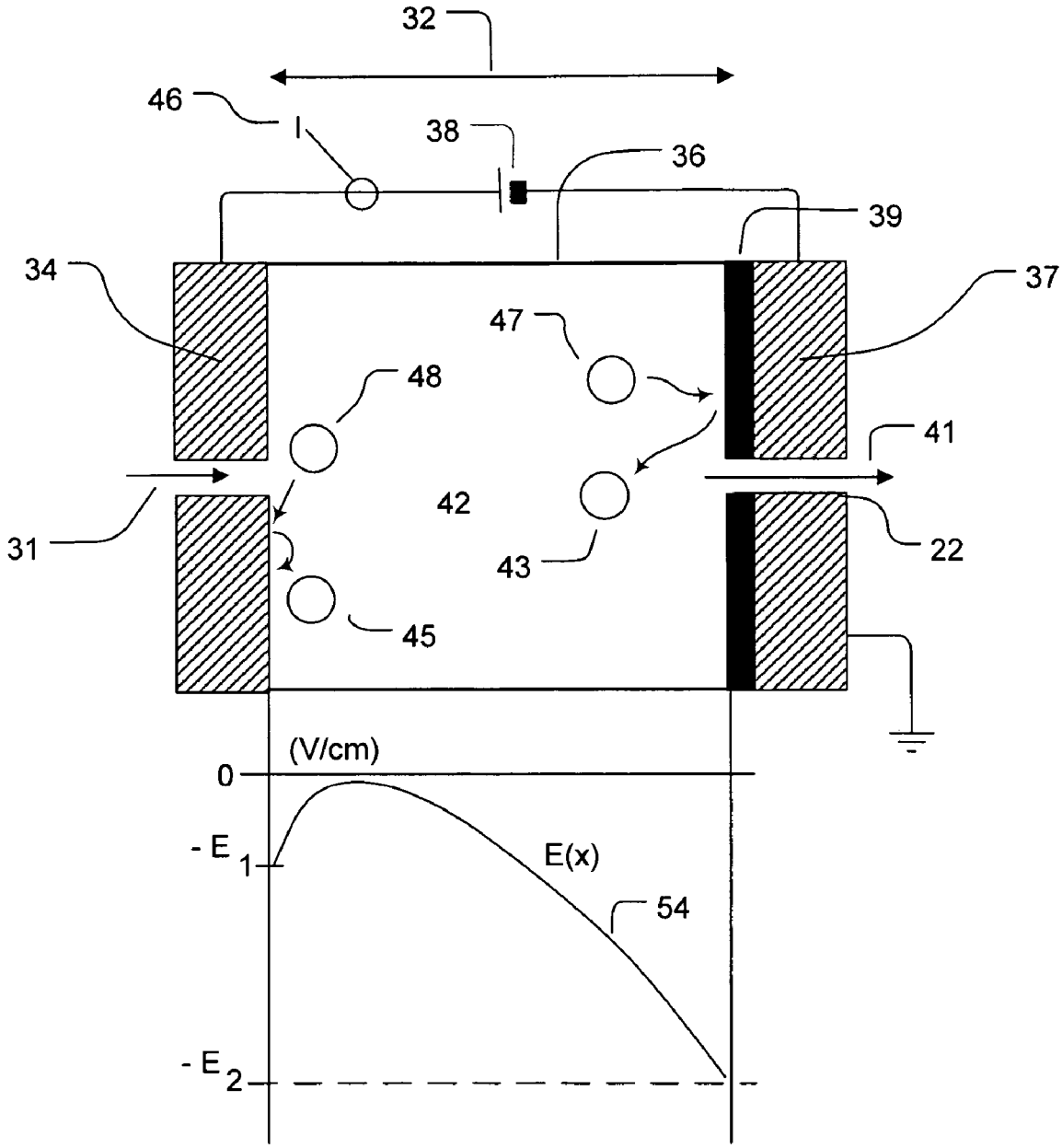
FIG. 4 shows a mechanism of the avalanche multiplication of the high current density microwave-initiated ion source according to principles described herein.

FIG. 4 shows the mechanism of the avalanche multiplication of the high current density microwave-initiated ion source 20 of FIG. 2. Under both the excitation of the microwave field 32 and a DC bias, a stream of positive ions 47 flows in the same direction of the DC electric field to the cathode 37 while a stream of electrons 48 flows to the anode 34. The opposite flow of electron 44 and ion 47 streams cause space charge layers to form with the majority carrier being "negative charge" at the anode 34 and "positive charge" at the cathode 37 respectively. This grouping of negative charge at the anode 34 and positive charge at the cathode 37 results in the narrowing of the neutral plasma (non-space charge) region near the central portion. Such space charge distribution results in opposite slopes of the electric field and provides high electric field at both electrodes.

However, due to a much lower mobility of the ions compared to that of the electrons, the voltage in the ion space charge is much higher and hence the ions may cause electron 43 ejection from the cathode 37. Electrons 43 so ejected are swept by the DC electric field into the plasma and cause further ionization in the gas. This cycle is repeated until a steady state is reached. This process of electron rejection from the cathode 37 that results in further ionization is known as "avalanche multiplication." Avalanche multiplication occurs when the positive ions 47 impinge on the surface of the cathode material 39 and transfer their energy to the valence electrons to overcome the work function of the cathode material 39 and leave the cathode 37. Alternatively, the presence of the ions 47 on the cathode material 39 can cause the work function to lower such that the electrons 43 tunnel (quantum mechanically) out from the cathode 37. Therefore, the ion-induced secondary electron emission plays a "feedback" role in the avalanche multiplication process which produces higher conduction charge density in the plasma when the DC electric field at the surface of the cathode 37 is sufficiently high. In some embodiments, the microwave power is turned off after sufficient avalanche process takes over.

The ion beam current density can be increased by using the cathode 37 which yields a sufficiently high number of secondary electron emissions and/or by using the DC electric field to cause the impact ionization to further increase the number of ions in the space-charge layer. This can be understood from a graph 54 displaying the results of a computer simulation, also shown in FIG. 4. The graph 54 demonstrates how the current density can be multiplied, limited, and controlled by the various forms of electric field distribution E(x) in the gas, as shown in FIG. 4.

In summary, the controlling factors for the avalanche multiplication are:

1) The electric field at the surface of the cathode 37 is high enough to allow the ions in the space-charge layer near the surface of the cathode 37 to be of higher kinetic energy than the work function of cathode material 39 to yield secondary electrons, and/or 2) The surface of cathode 37 is made out of a material 39 having a low work function and is conducive to yielding secondary electrons. The cathode material 39 is able to endure ion bombardment such that the cathode material 39 may have a long useful life. Some types of cathode material 39, such as aluminum, may undergo a process of anodization.

3) The electric field distribution is also high enough to cause collisions between the electrons and neutral atoms and thereby cause impact ionization.

In some embodiments, the cathode 37 is made of stainless steel. A thin aluminum plate may cover the inner surface of the stainless steel. The aluminum plate may be coated with an oxide film that allows the aluminum to produce more secondary electrons 45. Secondary electrons 45 may also be produced when electrons impinge on the anode. However, these secondary electrons 45 are attracted by the electric field back to the anode. The oxide film may also serve to minimize damages due to ion bombardment of the cathode 37.

Figure 5:
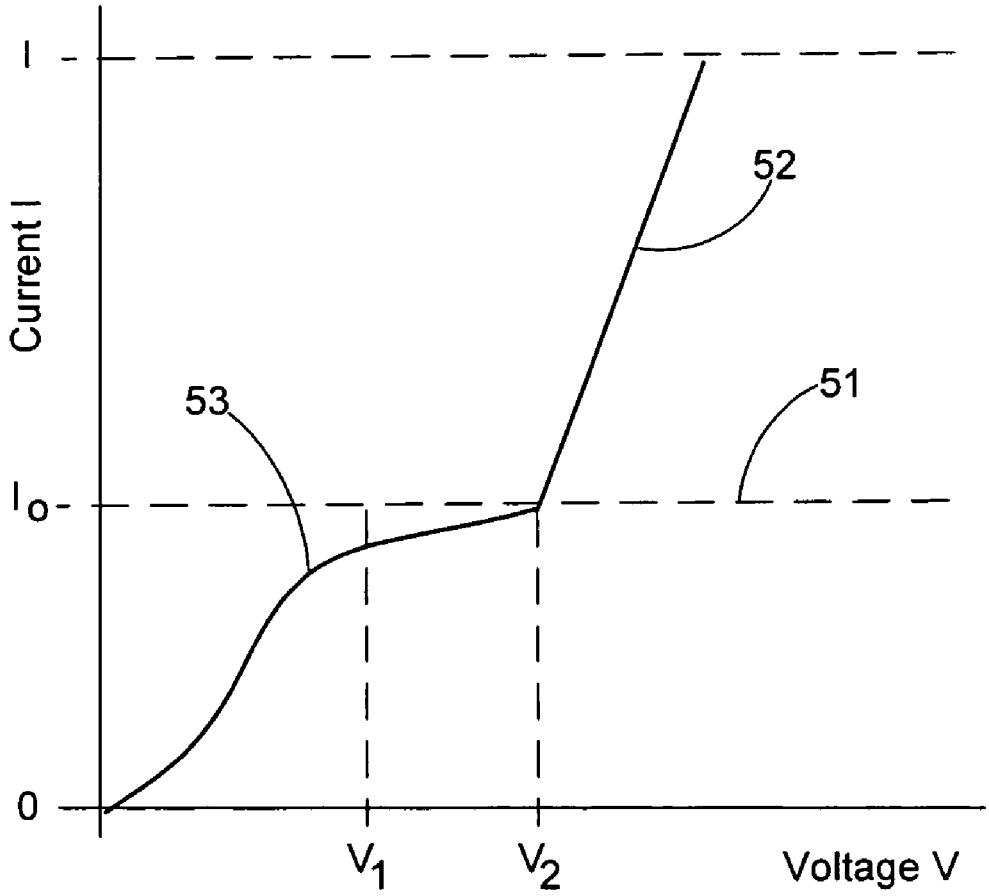
FIG. 5 shows a relationship between current and voltage of the high-density microwave plasma source according to principles described herein.

FIG. 5 shows the relationship between the current 46 and the potential 38 of the high-density microwave-initiated plasma source. In one exemplary mode of operation, when a small bias potential from the power supply 38 is applied to the anode 34 and cathode 37 electrodes, the electrons and ions move in opposite directions. Thus, space-charge layers of "positive" and "negative" charges are produced at the surfaces of the cathode 37 and the anode 34 respectively. The density of electrons and ions within the space-change layers are a function of the magnitude of the potential 38 and, at least in part, determine the plasma conductivity.

Figure 1:
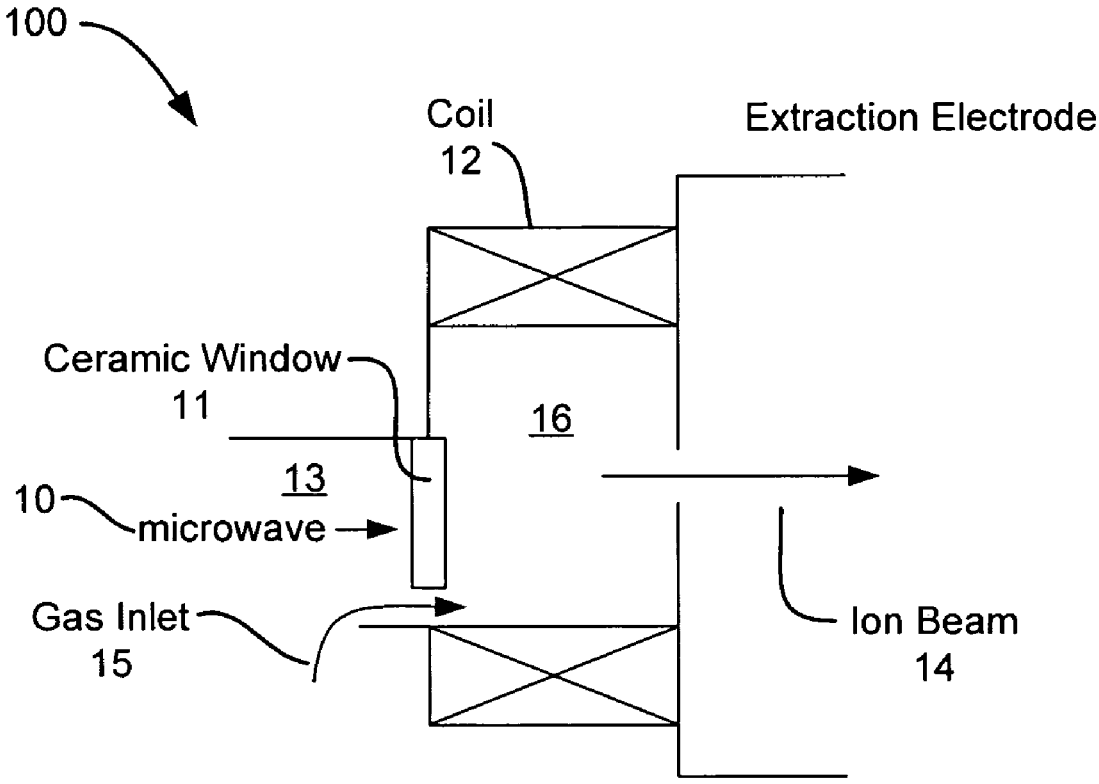
Fig. 1 (Prior Art)
FIG. 1 illustrates an exemplary Electron Cyclotron Resonance (ECR) Ion Source according to principles described herein.

In the region between 0-V1 volt, as shown in FIG. 5, the current 53 is proportional to the voltage squared, i.e. $1 \propto V^2$. However, in a conventional plasma source, such as the ECR ion source 100 of FIG. 1, the current follows the Langmuir-Child Law, i.e. $I \propto V^{3/2}$. In the case where avalanche multiplication does not occur, the limited ion density in plasma causes the current to approach saturation (e.g. 51 in FIG. 5). But in the case where the cathode 37 is configured to provide secondary electrons, the avalanche multiplication may occur due to the influence of DC and microwave electric fields. This avalanche multiplication may cause a "jump" in the value of the current from Io to I at a certain value of voltage V2, as illustrated by line 52. Hence, the avalanche multiplication may be used to provide substantially more conduction charge carriers and produce a high-density ion beam.

Figure 6:
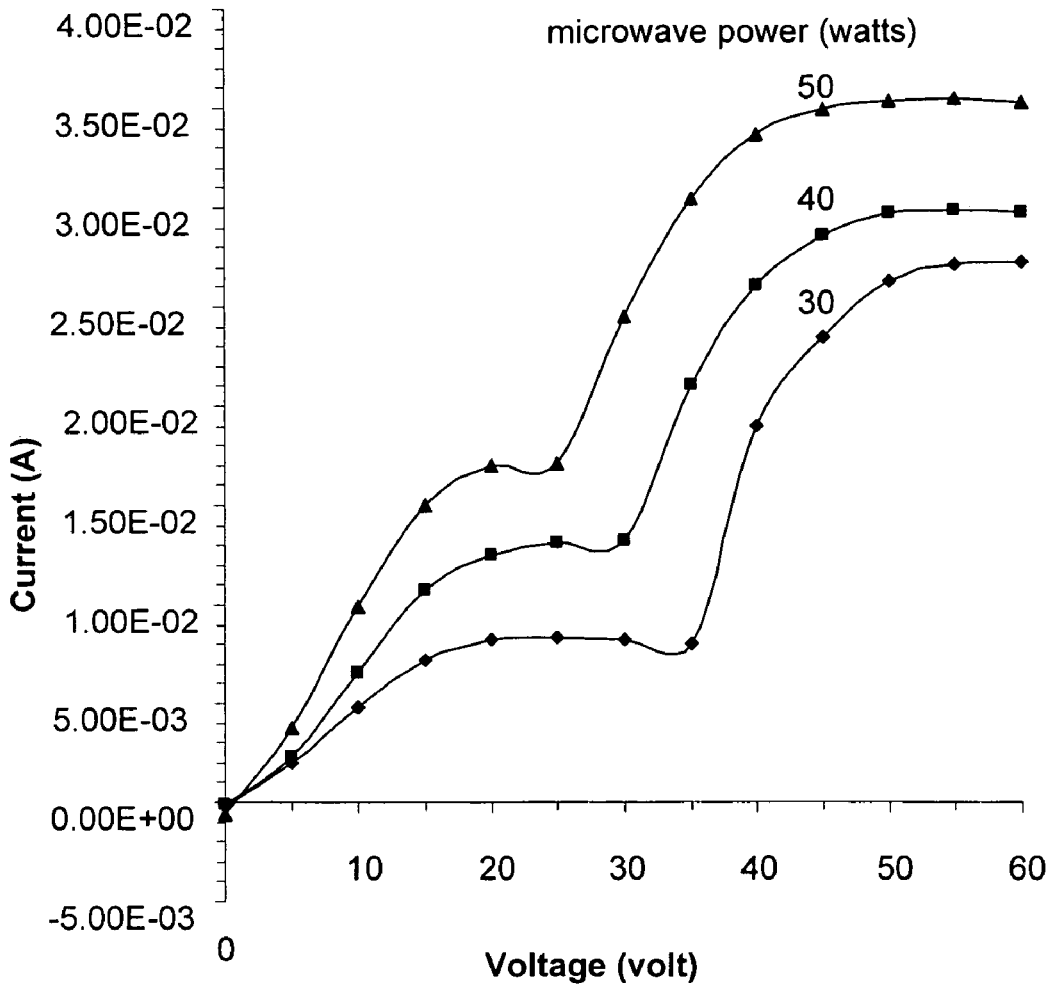
FIG. 6 shows an experimental relationship between current and voltage of the high-density microwave-initiated plasma source for 30, 40 and 50 watts microwave power according to principles described herein.

FIG. 6 is a graph illustrating experimental data that shows the relationship between the anode-cathode current and voltage of the high-density microwave-initiated plasma source with the microwave power equal to 30, 40 and 50 watts. The graph illustrates the results of the avalanche multiplication and shows the jump in magnitude of the current at different values of the voltage. Note that by using microwave power of 50 watts to ionize the gas, the electron and ion densities are higher than those available with the lower power levels of microwave. Therefore, with the higher electron and ion densities, the avalanche multiplication can be established and maintained more easily at lower voltage DC bias voltages.

Figure 7:
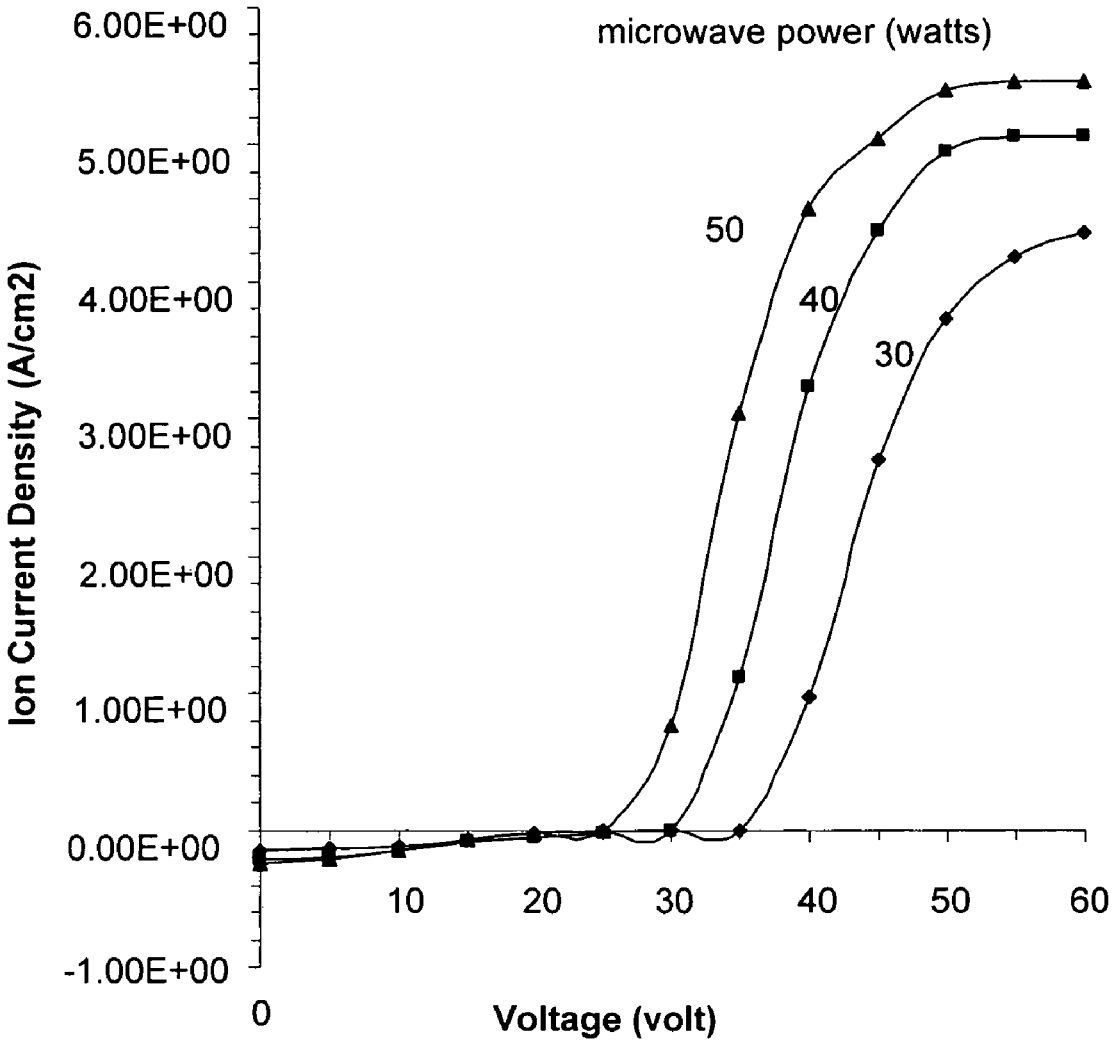
FIG. 7 shows an experimental relationship between ion current density and anode-cathode voltage of the high current density microwave-initiated ion source for 30, 40 and 50 watts microwave power according to principles described herein.

FIG. 7 shows the relationship between the exit ion beam current density and the potential between the anode and cathode electrodes in the cases initiated by the microwave power of 30, 40 and 50 watts. As explained previously, the ions in the space charge layer near the surface of cathode 37 are partly driven by the pressure gradient through the ion exit hole 22 into the vacuum chamber 43. Thus, the ion beam 41 may be collected and measured with the grounded electrode 40 as shown in FIG. 3. Before the onset of the avalanche multiplication, the magnitude of ion beam current density is somewhat proportional to microwave power as the sole plasma energizer. However, as shown in FIG. 7, the avalanche process in the $10^{-1}$ mbar gas may produce sufficient ions to provide an ion current density of the orders of several 10 amperes per square centimeter ($A/cm^2$) even when using low power microwave as plasma initiator. Therefore, in some embodiments, a cooling system is not necessary. The produced ion beam will be a low temperature ion beam with an energy spread that is much less than the DC voltage, which in general is less than 50 volts (only a modest DC voltage is needed to cause the avalanche multiplication).

Furthermore, in some embodiments, the exemplary high current density microwave-initiated ion source described herein does not need a magnetic field for charge confinement. Moreover, when the ion source is accelerated externally with a high voltage, the energy spread remains substantially constant. The resultant high energy ion beam is thus relatively highly mono-energetic, in contrast to energy spread in an ion beam "pulled" directly from the plasma by the high voltage.

The ion source described herein may be used as a low cost ion beam source capable of producing a high intensity ion beam of arbitrarily high energy and with a very small energy spread and with low beam divergence. These features may be useful in many applications that require high resolution patterning, such as etching and ion-implantation in the micro designing of various materials and devices. Moreover, such high resolution patterning may be achieved in three dimensions.

The preceding description has been presented only to illustrate and describe embodiments of the invention. It is not intended to be exhaustive or to limit the invention to any precise form disclosed. Many modifications and variations are possible in light of the above teaching.

What is claimed is:

1. A high current density ion beam source comprising:

a plasma source for generating plasma;

a vacuum chamber coupled to said plasma source for extracting an ion beam from said plasma generated by said plasma source;

a microwave field source configured to produce a microwave field that causes an ionization of gas within said plasma source; and a direct current voltage source configured to initiate an avalanche multiplication within said plasma source;

wherein said avalanche multiplication increases said ionization of gas in said plasma source and causes an increase in a current density of said ion beam.

2. The ion beam source of claim 1, wherein said plasma source comprises:

a cathode configured to yield secondary electrons in said avalanche multiplication;

wherein said secondary electrons cause further ionization in said gas.

3. The ion beam source of claim 1, wherein said plasma source comprises a cylindrical plasma chamber made from an electrically non-conductive tube.

4. The ion beam source of claim 1, wherein said plasma source comprises a chamber made of quartz.

5. The ion beam source of claim 1, wherein a pressure within said plasma source is maintained to be in a range substantially equal to $10^{-1\pm1}$ mbar.

6. The ion beam source of claim 1, further comprising:

an ion exit hole configured to allow passage of an ion beam from said plasma source to said vacuum chamber;

wherein a pressure within said plasma source is controlled by balancing a flow of gas within a chamber of said plasma source through said ion exit hole into said vacuum chamber with an input flow of gas into said plasma source.

7. The ion beam source of claim 1, wherein said gas comprises Argon.

8. The ion beam source of claim 1, wherein ion beam has a temperature substantially equal to or less than 27 degrees Celsius.

9. The ion beam source of claim 1, wherein a total power consumption of said high current density ion source is substantially equal to or less than 50 watts.

10. The ion beam source of claim 1, wherein said ion beam source is configured to operate without the use of a cooling device.

11. The ion beam source of claim 1, wherein said microwave field source is configured to turn off said microwave field after said avalanche multiplication begins.

12. A method of producing a high current density ion beam, said method comprising:

generating plasma in a chamber of a plasma source;

extracting an ion beam from said plasma generated in said chamber of said plasma source;

applying a microwave field to said plasma to cause an ionization of gas within said chamber of said plasma source; and applying a direct current voltage to said plasma source to initiate an avalanche multiplication within said plasma source;

wherein said avalanche multiplication increases said ionization of gas in said plasma source and causes an increase in a current density of said ion beam.

13. The method of claim 12, further comprising maintaining a pressure within said plasma source within a range substantially equal to $10^{-1\pm1}$ mbar.

14. The method of claim 12, further comprising controlling a pressure within said plasma source by balancing a flow of gas within said chamber of said plasma source to a vacuum chamber with an input flow of gas into said chamber of said plasma source.

15. The method of claim 12, wherein said gas comprises Argon.

16. The method of claim 12, further comprising producing said high current density ion beam without using a cooling device.

17. The method of claim 12, further comprising using an amount of power substantially equal to or less than 50 watts to produce said high current density ion beam.

18. A system for producing a high current density ion beam, said system comprising:

means for generating plasma in a chamber of a plasma source;

means for extracting an ion beam from said plasma generated in said chamber of said plasma source;

means for applying a microwave field to said plasma to cause an ionization of gas within said chamber of said plasma source; and means for applying a direct current voltage to said plasma source to initiate an avalanche multiplication within said plasma source;

wherein said avalanche multiplication increases said ionization of gas in said plasma source and causes an increase in a current density of said ion beam.

19. The system of claim 18, further comprising means for maintaining a pressure within said plasma source within a range substantially equal to $10^{-1\pm1}$ mbar.

20. The system of claim 18, further comprising means for controlling a pressure within said plasma source by balancing a flow of gas within said chamber of said plasma source to a vacuum chamber with an input flow of gas into said chamber of said plasma source.

* * * * *